US006805262B1

(12) United States Patent
Frazier

(10) Patent No.: US 6,805,262 B1
(45) Date of Patent: Oct. 19, 2004

(54) MOUTHWASH DISPENSER

(76) Inventor: Daniel P. Frazier, 603 S. Vine, Holden, MO (US) 64040

( * ) Notice: Subject to any disclaimer, the term of this patent is extended or adjusted under 35 U.S.C. 154(b) by 0 days.

(21) Appl. No.: 10/405,256

(22) Filed: Apr. 3, 2003

(51) Int. Cl.[7] ..... B67D 1/16

(52) U.S. Cl. ..... 222/108; 222/181.3; 222/192; 222/518; 221/96

(58) Field of Search ..... 222/108, 185.1, 222/518, 501, 509, 181.3, 192, 154; 221/96

(56) References Cited

U.S. PATENT DOCUMENTS 3,315,850 A * 4/1967 Gran ..... 222/501
3,604,592 A * 9/1971 Bacon et al. ..... 221/96
3,765,577 A 10/1973 Bums, Jr.
3,987,932 A 10/1976 Maldon
4,026,442 A * 5/1977 Orton ..... 222/181.3
4,121,600 A 10/1978 Riddick et al.
4,271,986 A * 6/1981 Stecker ..... 222/151
5,275,305 A 1/1994 Gross
5,400,839 A 3/1995 Cravett
D378,642 S 4/1997 DeGennaro
5,713,492 A * 2/1998 DeGennaro ..... 222/153.03
5,833,097 A * 11/1998 Ruth ..... 222/368
5,960,995 A * 10/1999 Leatherman et al. ..... 222/108

* cited by examiner

*Primary Examiner*—Philippe Derakshani

(57) ABSTRACT

A mouthwash dispenser includes a housing having a bottom wall, a top wall and a peripheral wall extending between and being attached to the top and bottom walls. A dispensing outlet is fluidly coupled to the housing and extends away from the bottom wall. A valve assembly is fluidly coupled to the dispensing outlet for selectively opening or closing the dispensing outlet. A drain assembly retrieves fluid from the dispensing outlet. A mouthwash solution may be positioned in the housing such that mouthwash may be dispensed through the dispensing outlet. The drain assembly is positioned below the housing such that any spilled mouthwash will be caught in the drain assembly.

8 Claims, 5 Drawing Sheets

MOUTHWASH DISPENSER

BACKGROUND OF THE INVENTION

1. Field of the Invention

The present invention relates to dispensing devices and more particularly pertains to a new dispensing device for providing a user with a sanitary means to dispense mouthwash.

2. Description of the Prior Art

The use of dispensing devices is known in the prior art. U.S. Pat. No. 4,121,600 describes an oral hygiene dispenser for dispensing oral hygiene products. Another type of dispensing device is U.S. Pat. No. 3,987,932 describes a dispenser for restrooms that dispenses disposable cups, mouthwash, and toothpaste. U.S. Pat. No. 5,275,305 describes a cup and fluid dispenser that dispenses mouthwash and disposable cups incorporating a handle effect from the dispenser and is used in conjunction with a wall mounted bracket.

While these devices fulfill their respective, particular objectives and requirements, the need remains for a device that is easier to refill and eliminates the mess caused by the spillage of oral hygiene products.

SUMMARY OF THE INVENTION

The present invention meets the needs presented above by including an easily refillable housing for dispensing mouthwash. The present invention also utilizes a drain assembly that contains any spillage that might occur when dispensing mouthwash.

To this end, the present invention generally comprises a housing having a bottom wall, a top wall and a peripheral wall extending between and being attached to the top and bottom walls. A dispensing outlet is fluidly coupled to the housing and extends away from the bottom wall. A valve assembly is fluidly coupled to the dispensing outlet for selectively opening or closing the dispensing outlet. A drain assembly retrieves fluid from the dispensing outlet. A mouthwash solution may be positioned in the housing such that mouthwash may be dispensed through the dispensing outlet. The drain assembly is positioned below the housing such that any spilled mouthwash will be caught in the drain assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
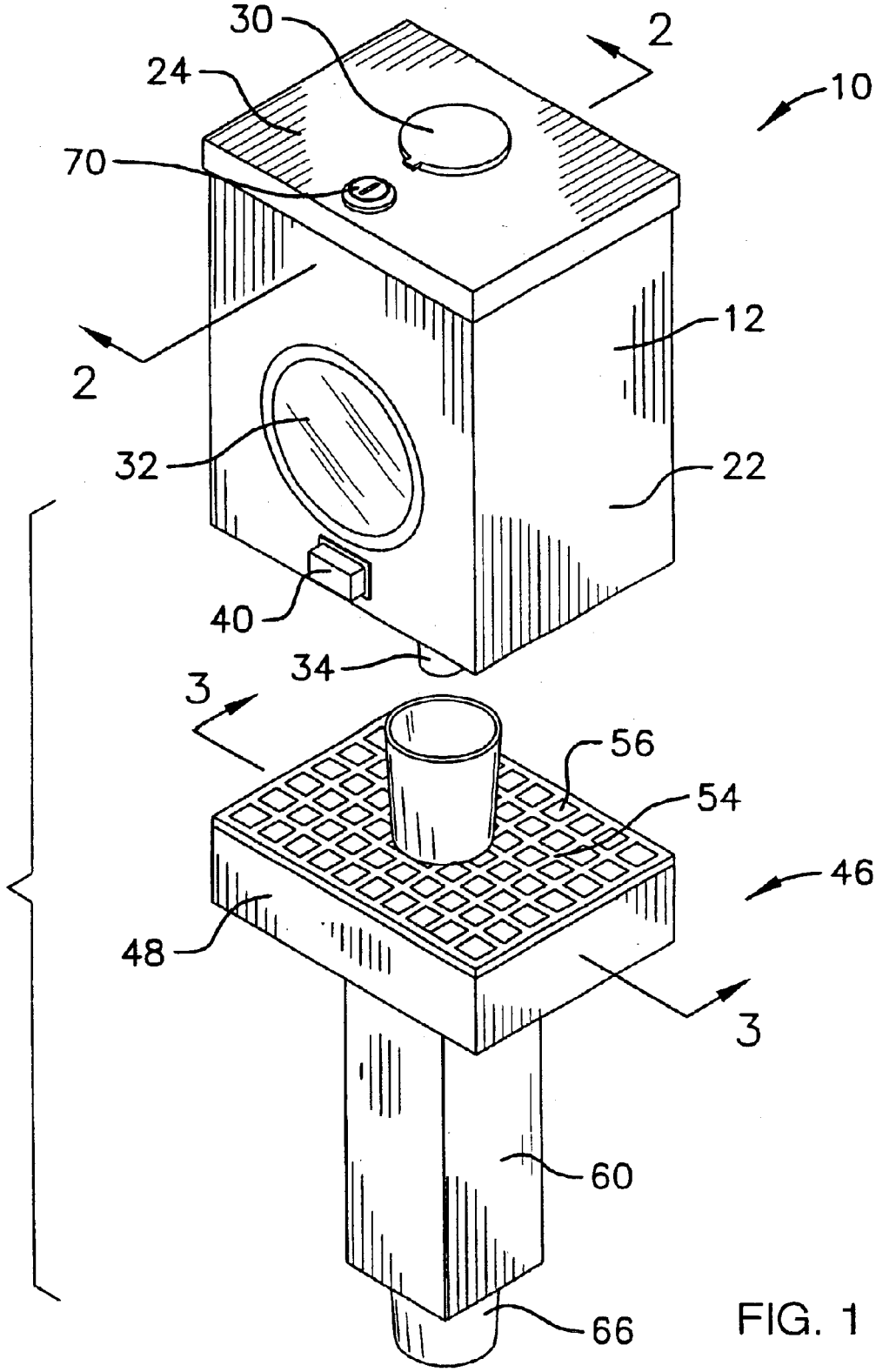
FIG. 1 is a perspective view of a mouthwash dispenser according to the present invention.
Figure 2:
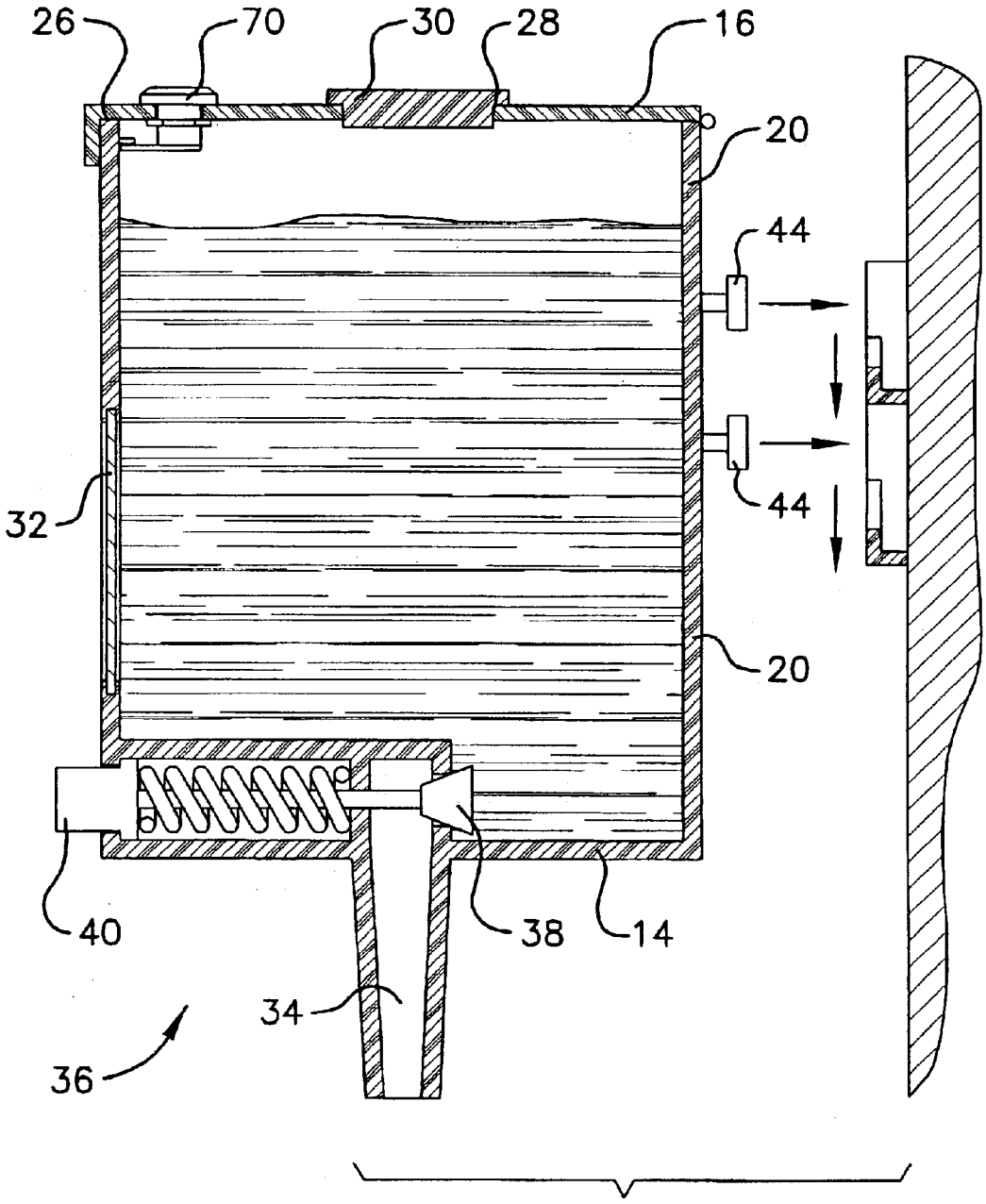
FIG. 2 is a cross-sectional view taken along the line 2—2 of FIG. 1 of the present invention.
Figure 3:
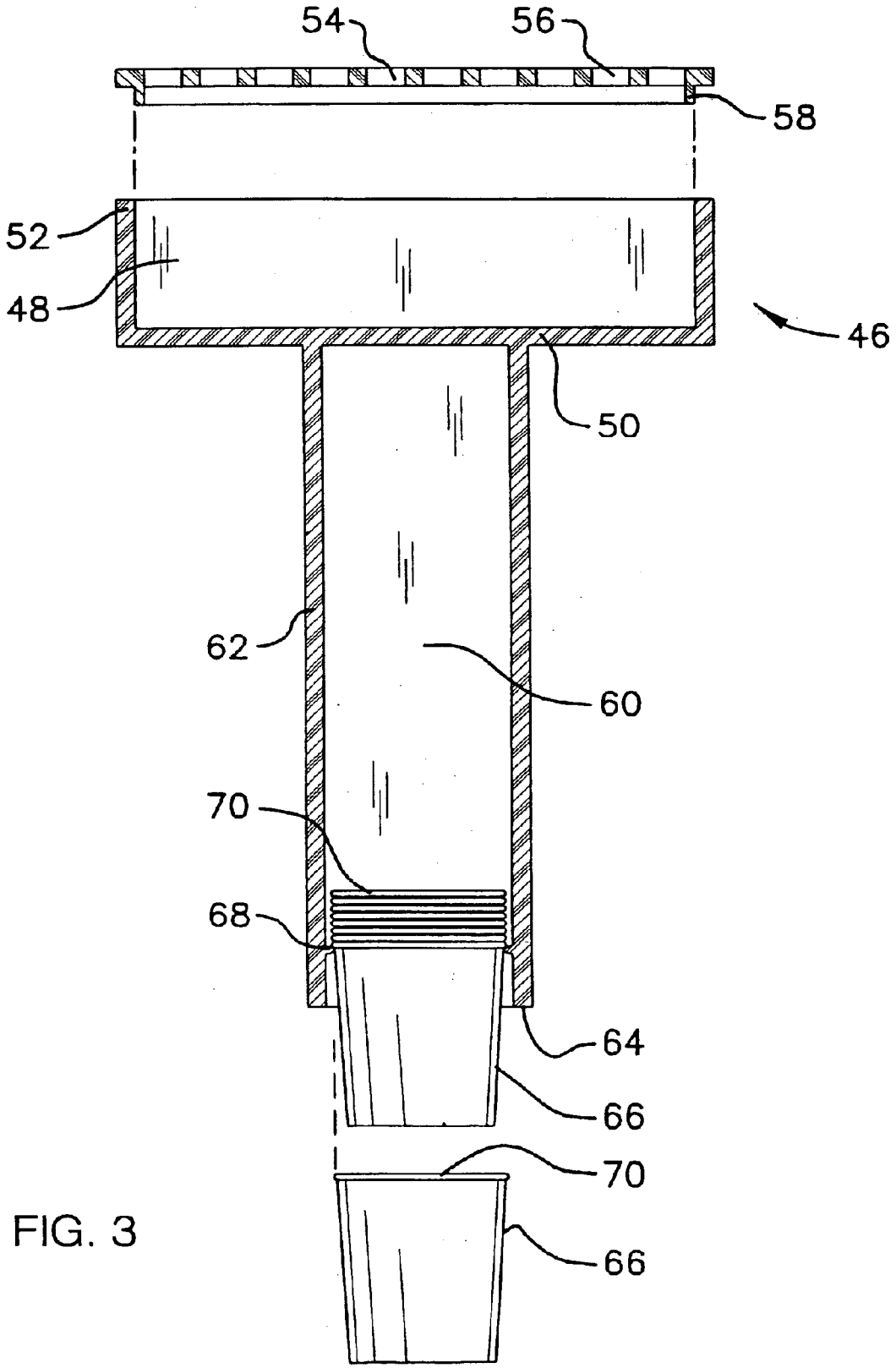
FIG. 3 is a cross-sectional view taken along the line 3—3 of FIG. 1 of the present invention.

With reference now to the drawings, and in particular to FIGS. 1 through 5 thereof, a new dispensing device embodying the principles and concepts of the present invention and generally designated by the reference numeral 10 will be described.

As best illustrated in FIGS. 1 through 5, the mouthwash dispenser 10 generally comprises a housing 12 having a bottom wall 14, a top wall 16 and a peripheral wall extending between and being attached to the top 16 and bottom 14 walls. The peripheral wall includes a front wall 18, a back wall 20, and a pair of side walls 22. A door 24 is positioned in the housing 12 for selectively accessing an interior of the housing 12. The top wall 16 defines the door 24 that is hingedly attached to an upper edge 26 of the peripheral wall. The top wall 16 has an opening 28 therein. A stopper 30 is selectively positioned in the opening 28.

A window 32 is positioned in the peripheral wall for selectively viewing an interior of the housing 12. The window 32 is positioned in the front wall 18. The window 32 is preferably comprised of a clear plastic material.

Figure 4:
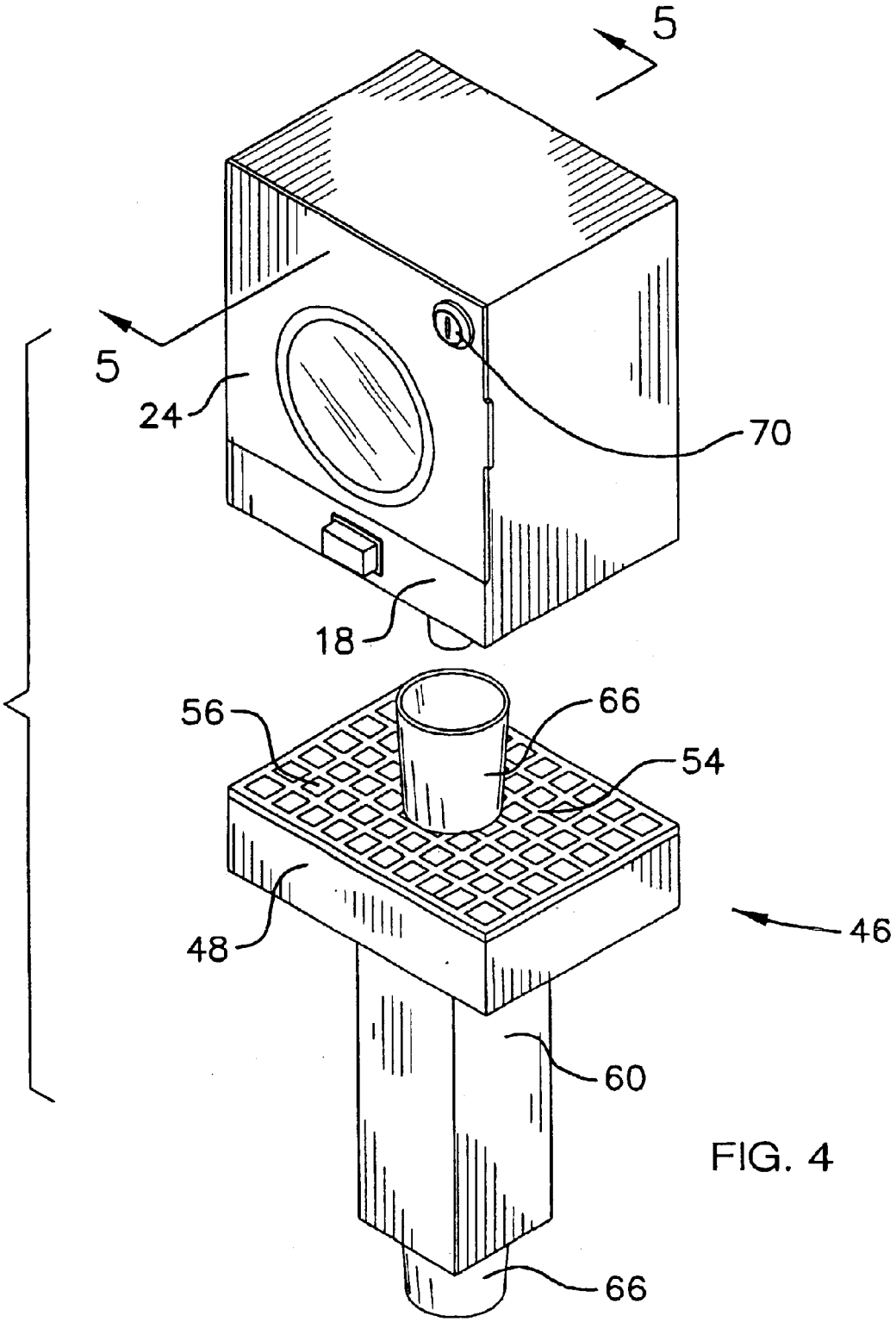
FIG. 4 is a perspective view of the present invention.
Figure 5:
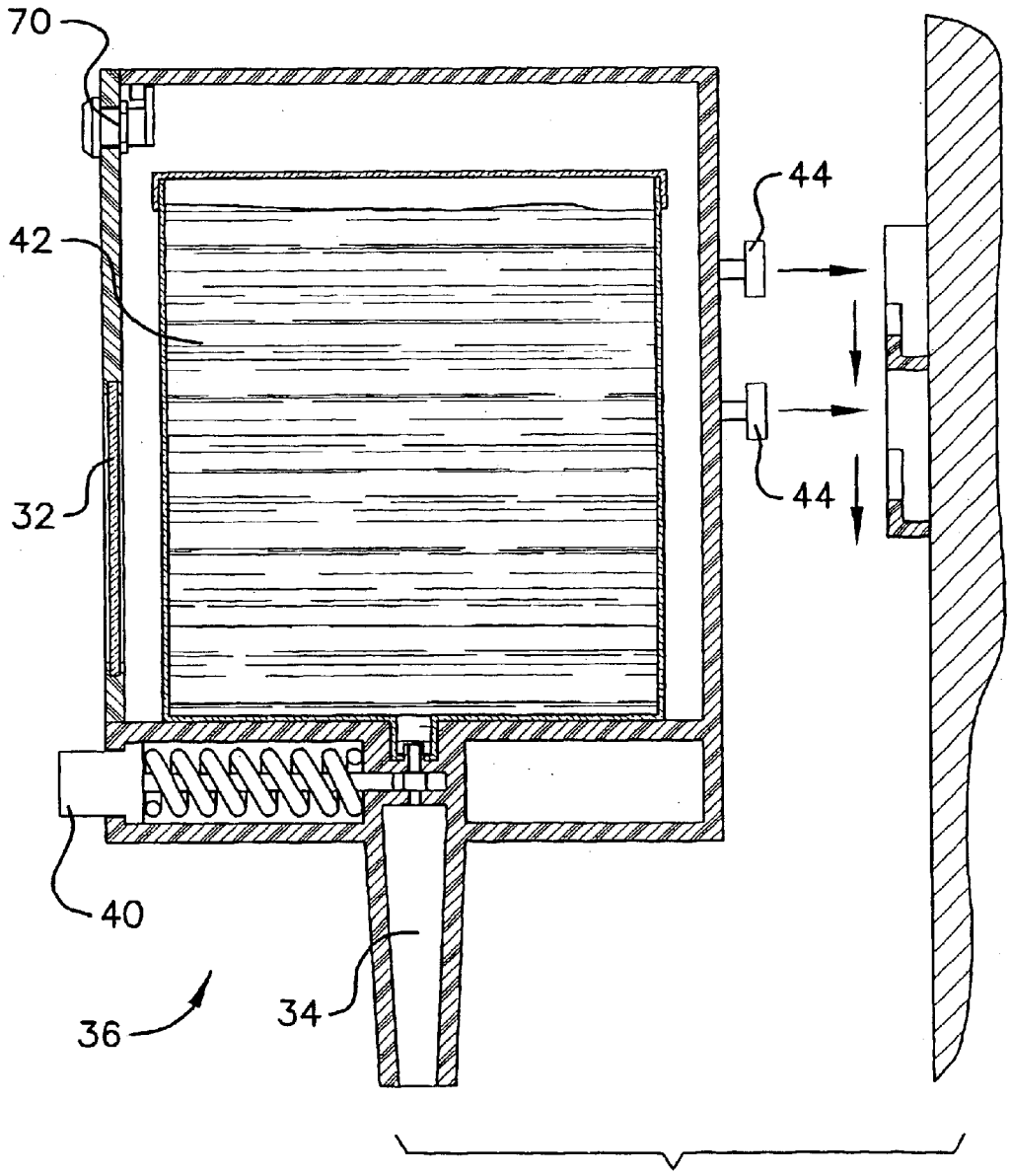
FIG. 5 is a cross-sectional view taken along the line 5—5 of FIG. 4 of the present invention.

A dispensing outlet 34 is fluidly coupled to the housing 12 and extends away from the bottom wall 14. A valve assembly 36 includes a plug 38, which is positioned in the dispensing outlet 34 for selectively opening or closing the dispensing outlet 34. The valve assembly 36 also includes an actuator 40 that is mechanically coupled to the plug 38 for positioning the plug 38 in an open position or a closed position. The actuator 40 extends through the front wall 18 of the housing 12. FIG. 5 depicts a second embodiment of the valve assembly 36. These are two examples of a multitude of suitable valve assemblies. Of importance is that the actuator 40 extends through the peripheral wall to enhance usage of the device. FIG. 4, also showing the second embodiment, includes a front wall 18 forming the door 24 and contains a removable container 42 for holding mouthwash solution. The valve assembly 36 may also include a mechanical or electrical metering assembly, not shown, for dispensing a measured amount of mouthwash through the dispensing outlet 34.

A securing member 44 is attached to an outer surface of the peripheral wall for selectively mounting the housing 12 on a vertical surface. The securing member 44 is preferably positioned on the back wall 20. The securing member 44 may be any conventional mechanical fastener for attaching the housing 12 on a wall or other vertical surface.

A drain assembly 46 for retrieving fluid from the dispensing outlet 34 includes a catch 48 having a base wall 50 and a perimeter wall 52 that is attached to and extends upwardly from the base wall 50. The perimeter wall 52 has an upper edge. A screen 54 has a shape and size so that it may be positioned on upper edge 26 such that the screen 54 covers the catch 48. The screen 54 has a plurality of openings 56 therein such that fluid may pass therethrough and onto the base wall 50. The screen 54 preferably has a peripheral flange 58 attached to a bottom of the screen 54. The flange 58 has a size to just fit inside of the perimeter wall 52 for holding the screen 54 in place. Ideally, a securing member 44 like the one attached to the housing 12 is attached to the drain assembly 46 for mounting the drain assembly 46 on a vertical surface and positioned below the housing 12.

A cup dispenser 60 is attached to the drain assembly 46. The cup dispenser 60 includes a tubular member 62 that is attached to and extends away from a bottom surface of the base wall 50. The tubular member 62 has an open free end 64 adapted for receiving and dispensing drinking cups 66. A peripheral lip 68 is attached to an inner surface of the tubular member 62 and is positioned generally adjacent to the free end 64. The peripheral lip 68 catches a lip 70 of the cups 66 so that they do not unintentionally fall out of the tubular member 62.

Additionally, a lock assembly 70 may be mounted on the housing 12 and preferably in the door 24 for selectively locking the door in a closed position. This will help ensure that the device 10 remains secure from tampering so that a person may not add any material to mouthwash positioned within the housing 12. The lock assembly 70 may be any conventional mechanical lock system. The lock assembly 70 also makes the device 10 child proof so that a child does not have the ability to get inside of the housing.

In use, a mouthwash solution may be positioned in the housing 12 such that mouthwash may dispense through the dispensing outlet 34. The drain assembly 46 is positioned below the housing 12 such that any mouthwash spilled will be caught in the drain assembly 46.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mouthwash dispensing system comprising:

a housing having a bottom wall, a top wall and a peripheral wall extending between and being attached to said top and bottom walls;

a dispensing outlet being fluidly coupled to said housing and extending away from said bottom wall;

a valve assembly being fluidly coupled to said dispensing outlet for selectively opening or closing said dispensing outlet;

a drain assembly for retrieving fluid from said dispensing outlet;

a cup dispenser being attached to said drain assembly, said cup dispenser including a tubular member being attached to and extending away from a bottom surface of said cup dispenser, said tubular member having an open free end adapted for receiving and dispensing drinking cups, a peripheral lip being attached to an inner surface of said tubular member and being positioned Generally adjacent to said free end; and wherein a mouthwash solution may be positioned in said housing such that mouthwash may dispensed through said dispensing outlet, wherein said drain assembly may be positioned below said housing such that any mouthwash spilled will be caught in said drain assembly.

2. The mouthwash dispensing system of claim 1, further including a door being positioned in said housing for selectively accessing an interior of said housing.

3. The mouthwash dispensing system of claim 2, wherein said top wall defines said door and being hingedly attached to an upper edge of said peripheral wall.

4. The mouthwash dispensing system of claim 1, wherein said top wall has an opening therein, a stopper being selectively positioned in said opening.

5. The mouthwash dispensing system of claim 1, further including a window being positioned in said peripheral wall for selectively viewing an interior of said housing.

6. The mouthwash dispensing system of claim 1, wherein said valve assembly includes a plug being positioned in said dispensing outlet for selectively opening or closing said dispensing outlet, said valve assembly also including an actuator being mechanically coupled to said plug for positioning said plug in an open position or a closed position, said actuator extending through said peripheral wall.

7. The mouthwash dispensing system of claim 1, wherein said drain assembly includes a catch having a base wall and a perimeter wall being attached to and extending upwardly from said base wall, said perimeter wall having an upper edge, a screen having a shape and size for being positioned on upper edge such that said catch is covered by said screen, said screen having a plurality of openings therein such that fluid may pass therethrough and onto said base wall.

8. A mouthwash dispensing system comprising:

a housing having a bottom wall, a top wall and a peripheral wall extending between and being attached to said top and bottom walls, said peripheral wall including a front wall, a back wall, and a pair of side walls, a door being positioned in said housing for selectively accessing an interior of said housing, wherein said top wall defines said door and being hingedly attached to an upper edge of said peripheral wall, said top wall having an opening therein, a stopper being selectively positioned in said opening;

a window being positioned in said peripheral wall for selectively viewing an interior of said housing, said window being positioned in said front wall;

a dispensing outlet being fluidly coupled to said housing and extending away from said bottom wall;

a valve assembly including a plug being positioned in said dispensing outlet for selectively opening or closing said dispensing outlet, said valve assembly also including an actuator being mechanically coupled to said plug for positioning said plug in an open position or a closed position, said actuator extending through said front wall of said housing;

a securing member being attached to an outer surface of said peripheral wall for selectively mounting said housing on a vertical surface, said securing member being positioned on said back wall;

a drain assembly for retrieving fluid from said dispensing outlet including;

a catch having a base wall and a perimeter wall being attached to and extending upwardly from said base wall, said perimeter wall having an upper edge;

a screen having a shape and size for being positioned on upper edge such that said catch is covered by said screen, said screen having a plurality of openings therein such that fluid may pass therethrough and onto said base wall;

a cup dispenser being attached to said drain assembly, said cup dispenser including a tubular member being attached to and extending away from a bottom surface of said base wall, said tubular member having an open free end adapted for receiving and dispensing drinking cups, a peripheral lip being attached to an inner surface of said tubular member and being positioned generally adjacent to said free end; and wherein a mouthwash solution may be positioned in said housing such that mouthwash may dispensed through said dispensing outlet, wherein said drain assembly may be positioned below said housing such that any mouthwash spilled will be caught in said drain assembly.

* * * * *